US009067704B2

(12) United States Patent
Fracasso

(10) Patent No.: US 9,067,704 B2
(45) Date of Patent: Jun. 30, 2015

(54) CONTAINER FOR PRODUCTS, PARTICULARLY FOR FLUID PRODUCTS

(75) Inventor: Giuseppe Fracasso, Caldogno (IT)

(73) Assignee: Giflor S.R.L., Grumolo delle Abbadesse (VI) (IT)

( * ) Notice: Subject to any disclaimer, the term of this patent is extended or adjusted under 35 U.S.C. 154(b) by 0 days.

(21) Appl. No.: 14/349,110

(22) PCT Filed: Nov. 2, 2011

(86) PCT No.: PCT/IT2011/000367
§ 371 (c)(1),
(2), (4) Date: Apr. 2, 2014

(87) PCT Pub. No.: WO2013/051038
PCT Pub. Date: Apr. 11, 2013

(65) Prior Publication Data

US 2014/0246430 A1 Sep. 4, 2014

(30) Foreign Application Priority Data

Oct. 5, 2011 (IT) ..... VI2011A0267

(51) Int. Cl.
*B65D 1/32* (2006.01)
*B65D 35/08* (2006.01)
*B65D 47/08* (2006.01)

(52) U.S. Cl.
CPC *B65D 1/32* (2013.01); *B65D 35/08* (2013.01); *B65D 47/0838* (2013.01)

(58) Field of Classification Search
CPC ..... B65D 1/32
USPC ..... 206/277; 220/263, 810, 847, 666; 215/235, 218
See application file for complete search history.

(56) References Cited

U.S. PATENT DOCUMENTS 7,766,197 B2 * 8/2010 Getsy ..... 222/480
2002/0175137 A1 * 11/2002 Rousselet ..... 215/235
(Continued)

FOREIGN PATENT DOCUMENTS

DE 296 21 990 3/1997
EP 1 260 451 11/2002
(Continued)

*Primary Examiner* — Steven A. Reynolds
*Assistant Examiner* — King M Chu
(74) *Attorney, Agent, or Firm* — Fattibene and Fattibene LLC; Paul A. Fattibene

(57) ABSTRACT

The present invention concerns a container (1; 71; 121; 201) for a fluid product, comprising: a main body (2; 72; 122) suited to define an inner area (3) suited to contain the product, the main body (2; 72; 122) ending with an edge (6; 126) in a terminal area (5; 125) of the container (1; 71; 121; 201); an opening (7) for dispensing the product associated with the terminal area (5; 125) of the container (1; 71; 121; 201); connection means (8) suited to allow the coupling of a closing element (50; 80; 90; 100; 110) for the opening (7), the connection means (8) comprising a projecting portion (9) that extends longitudinally along a main axis (X) from a base area (10) associated with the terminal area (5; 125) of the container (1; 71; 121; 201); a transition area (2; 212) suited to connect the edge (6; 126) of the main body (2; 72; 122) to the base area (10) of the connection means (8). At least one portion of the edge (6; 126) of the main body (2; 72; 122) and at least one portion of the base area (10) of the connection means (8) are crossed by an inclined axis (Z) that together with the main axis (X) of the projecting portion (9) defines an angle (A) included between 70° and 90°.

16 Claims, 9 Drawing Sheets

(56) References Cited

U.S. PATENT DOCUMENTS

| | | | | |
|---|---|---|---|---|
| 2003/0116879 | A1* | 6/2003 | Mueller et al. | 264/142 |
| 2005/0061765 | A1* | 3/2005 | Skillin et al. | 215/235 |
| 2007/0144996 | A1* | 6/2007 | Sawyer | 215/235 |
| 2007/0199959 | A1* | 8/2007 | Getsy | 222/480 |
| 2007/0199962 | A1* | 8/2007 | Mengeu | 222/575 |
| 2008/0142544 | A1* | 6/2008 | Pottish et al. | 222/92 |
| 2010/0224633 | A1* | 9/2010 | Gelardi | 220/315 |
| 2011/0248048 | A1* | 10/2011 | Fernandez De Mendiola Quintana et al. | 222/207 |
| 2014/0224802 | A1* | 8/2014 | Gonnert et al. | 220/265 |

FOREIGN PATENT DOCUMENTS

| | | |
|---|---|---|
| EP | 2 181 932 | 5/2010 |
| EP | 2 314 519 | 4/2011 |
| FR | 2 824 811 | 11/2002 |
| GB | 2 389 357 | 12/2003 |

* cited by examiner

CONTAINER FOR PRODUCTS, PARTICULARLY FOR FLUID PRODUCTS

TECHNICAL FIELD OF THE INVENTION

The present invention concerns the field of container production. In particular, the present invention concerns the field of the containers used to contain fluid products, such as bath products or cosmetic products, for example shampoos, bath foams, toothpastes, cosmetic creams and the like.

In greater detail, the present invention concerns a container in the shape of a collapsible tube, suited to be squeezed in order to allow the outflow of the product contained therein.

DESCRIPTION OF THE STATE OF THE ART

Various types of containers are known that are suited to contain widely used products, for example bath products like shampoos, bath foams, toothpastes or cosmetic products like cosmetic creams and the like.

Said containers are typically constituted by a tube-shaped containment portion provided at one end with a hole for dispensing the product.

A cap suited to close said hole is applied to this end. The cap is usually applied to the container through pressure or through a screwing operation.

According to the known technique, the terminal area of the containment portion provided with the hole for dispensing the product has the shape of a truncated cone, said shape being defined by an inclined surface that starting from the periphery of the container tapers towards the centre where the dispensing hole is located. At the level of the dispensing hole there are also the connection means necessary for the application of the cap, like for example snap-in connection means or threaded elements that allow the cap to be screwed to the container.

The inclined surface favours the product flow from the inside of the container towards the dispensing hole when the container is squeezed. For this reason the inclination of said surface is sufficiently high, for example with inclination values of approximately 60°.

The manufacture of this type of containers typically requires the use of two types of material. The tubular containment portion is made of a first plastic material with elastic compliance properties and is preferably obtained through injection moulding, drawing or rolling techniques. The truncated cone-shaped terminal area provided with the connection means is made of a second material with higher mechanical hardness than the tubular portion, in order to guarantee higher mechanical resistance when the cap is applied thereto.

Typically, the tubular containment portion and the terminal area are produced separately using the two different materials and then connected to each other through a heat-sealing process.

According to the known technique, the caps for said containers are made of plastic and consist of two parts: a first fixed part suited to be connected to the container and a second moving part in the shape of a cover. The two parts are advantageously connected by means of an articulated joint. Typically, the two parts define a single body obtained by moulding.

The first fixed part of the cap is associated with the terminal area of the container and is provided with a dispensing hole that is closed and/or opened by operating the cover.

The peripheral surface of the first fixed part of the cap advantageously has a shape that matches the shape of the terminal area of the container with which it is associated. In particular, the first fixed part is typically provided with a collar that adheres to the periphery of said terminal area in order to cover the inclined truncated cone-shaped surface substantially defining an extension of the tubular shape of the container.

The height of the collar is therefore sufficient to cover the whole truncated cone-shaped area of the end of the container.

The solution provided according to the state of the art, however, poses some drawbacks.

A drawback posed by said technique of known type lies in that in order to cover the whole truncated cone-shaped area of the container the collar of the cap must be considerably high.

This negatively affects the cost of the raw material used for making the cap.

Another drawback posed by said technique is constituted by the fact that the area defined between the cap collar and the inclined truncated cone-shaped surface of the container is substantially empty.

This affects the overall dimensions of the unit made up of the container and the cap.

A further drawback posed by said technique lies in that when the container is squeezed to dispense the product the cap may come off.

The main object of the present invention is thus to solve or at least partially overcome the above mentioned problems that characterize the solutions known in the state of the art.

In particular, it is one object of the present invention to propose a container that makes it possible to reduce the amount of raw material used and therefore the costs of the unit made up of the container and the cap.

It is another object of the present invention to propose a container that makes it possible to reduce the overall dimensions compared to the known art.

It is another object of the present invention to propose a container that makes it possible to improve the ratio between the final overall dimensions of the unit made up of the container and the cap and the product contained in the container.

SUMMARY OF THE PRESENT INVENTION

According to a first aspect of the invention, the subject of the same is therefore a container for a fluid product, comprising:

- a main body suited to define an inner area where said product is contained, said main body ending with an edge in a terminal area of said container;
- an opening for dispensing said product associated with said terminal area of said container;
- connection means suited to allow the connection of a closing element for said opening, said connection means comprising a projecting portion that extends longitudinally along a main axis from a base area associated with said terminal area of said container;
- a transition area suited to connect said edge of said main body to said base area of said connection means, wherein at least one portion of said edge of said main body and at least one portion of said base area of said connection means are crossed by an inclined axis that together with said main axis of said projecting portion defines an angle included between 70° and 90°.

The angle is preferably included between 75° C. and 85° C., more preferably it is equal to 80° C.

According to a preferred embodiment of the invention, the ratio between the extension of the transition area along the main axis and the extension of the connection means along the main axis is included between 0 and 2.5.

Said ratio is advantageously included between 0 and 2, and is preferably equal to 1.5.

The extension of the transition area is preferably included between 0 mm and 10 mm.

More preferably, the extension of the transition area is included between 0 mm and 6 mm, even more preferably it is equal to 3 mm.

The extension of the connection means of the container is preferably included between 1 mm and 6 mm.

More preferably, the extension of the connection means is included between 1.5 mm and 5 mm, even more preferably it is equal to 4 mm.

According to a preferred embodiment of the invention, the transition area has the shape of a truncated cone.

According to another preferred embodiment of the invention, the transition area has a waved shape.

The main body is preferably tubular in shape.

The main body suitably comprises at least one portion that is elastically yielding.

According to a preferred embodiment of the invention, the main body is made of a plastic material.

Advantageously, said plastic material belongs to the group including: polypropylene, polyethylene and combinations of the same.

The connection means preferably comprise snap-in connection means.

Advantageously, the outside of the projecting portion is provided with at least one coupling tooth suited to snap into a seat provided in the closing element.

According to another preferred embodiment of the invention, the connection means comprise screw-on connection means.

The projecting portion suitably comprises at least one threaded portion suited to be engaged in a nut screw of the closing element.

The projecting portion preferably comprises a cylindrical portion.

Advantageously, the main axis coincides with the axis of the cylindrical portion.

The dispensing opening is suitably created in the projecting portion.

According to a second aspect of the present invention, the subject of the same is a container for a fluid product, comprising:

- a main body suited to define an inner area where said product is contained, said main body ending with an edge in a terminal area of said container;
- an opening for dispensing said product associated with said terminal area of said container;
- connection means suited to allow the connection of a closing element for said opening, said connection means comprising a projecting portion that extends longitudinally along a main axis from a base area associated with said terminal area of said container;
- a transition area suited to connect said edge of said main body to said base area of said connection means;

wherein the ratio between the extension of said transition area along said main axis and the extension of said connection means along said main axis is included between 0 and 2.5.

Said ratio is advantageously included between 0 and 2, and is preferably equal to 1.5.

The extension of the transition area is preferably included between 0 mm and 10 mm.

More preferably, the extension of the transition area is included between 0 mm and 6 mm, even more preferably it is equal to 3 mm.

The extension of the connection means of the container is preferably included between 1 mm and 6 mm.

More preferably, the extension of the connection means is included between 1.5 mm and 5 mm, even more preferably it is equal to 4 mm.

According to a preferred embodiment of the invention, at least one portion of the edge of said main body and at least one portion of the base area of said connection means are crossed by an inclined axis that together with the main axis of the projecting portion defines an angle included between 70° and 90°.

The angle is preferably included between 75° C. and 85° C., more preferably it is equal to 80° C.

According to a preferred embodiment of the invention, the transition area has the shape of a truncated cone.

According to another preferred embodiment of the invention, the transition area has a waved shape.

The main body is preferably tubular in shape.

The main body suitably comprises at least one portion that is elastically yielding.

According to a preferred embodiment of the invention, the main body is made of a plastic material.

Advantageously, said plastic material belongs to the group including: polypropylene, polyethylene and combinations of the same.

The connection means preferably comprise snap-in connection means.

Advantageously, the outside of the projecting portion is provided with at least one coupling tooth suited to snap into a seat provided in the closing element.

According to another preferred embodiment of the invention, the connection means comprise screw-on connection means.

The projecting portion suitably comprises at least one threaded portion suited to be engaged in a nut screw of the closing element.

The projecting portion preferably comprises a cylindrical portion.

Advantageously, the main axis coincides with the axis of the cylindrical portion.

The dispensing opening is suitably created in the projecting portion.

According to a third aspect of the invention, the subject of the same is a closing element for a container for a fluid product, comprising:

- a base portion comprising a collar having an edge suited to be arranged so that it bears against a terminal area of said container;
- connection means suited to allow connection to said container, said connection means comprising a connecting portion that extends longitudinally along a main axis and ends in a terminal area suited to be placed in contact with connection means of said container;
- an opening for the passage of said product coming from said container and means for opening/closing said opening;

wherein at least one portion of said edge of said base portion and at least one portion of said end portion of said connection means are crossed by an inclined axis that together with said main axis of said connecting portion defines an angle included between 70° and 90°.

Said angle is preferably included between 75° C. and 85° C., more preferably it is equal to 80° C.

Advantageously, the terminal area of the connection means has a shape that substantially matches the shape of the terminal area of said container.

According to a further aspect of the present invention, the subject of the same is a unit comprising a fluid container and a closing element associated with the container, wherein the container is a container according to the description provided above and the closing element is a closing element according to the description provided above.

BRIEF DESCRIPTION OF THE DRAWINGS

Further advantages, objects and characteristics, as well as further embodiments of the present invention are defined in the claims and will be illustrated in the following description, with reference to the enclosed drawings; in the drawings, corresponding or equivalent characteristics and/or components of the present invention are identified by the same reference numbers. In particular:

DETAILED DESCRIPTION OF THE PRESENT INVENTION

Figure 3:
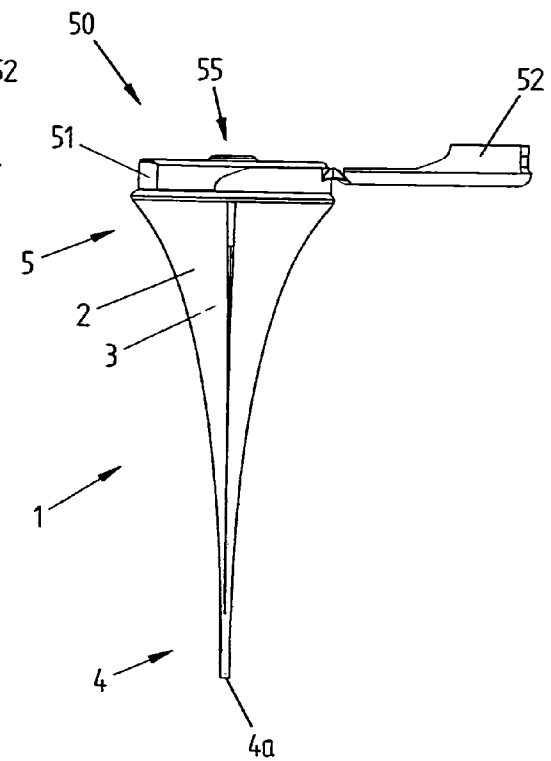
FIG. 3 shows the container shown in FIG. 2 in squeezed configuration during use.
Figure 2:
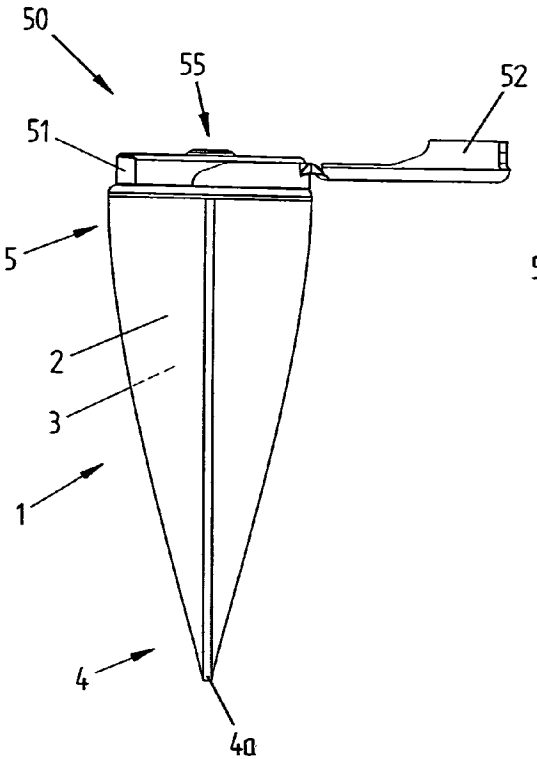
FIG. 2 shows a side view of the container shown in FIG. 1 with the cap in open configuration.

Although the present invention is described below with reference to its embodiments illustrated in the drawings, the present invention is not limited to the embodiments described below and illustrated in the drawings.

On the contrary, the embodiments described and illustrated in the drawings clarify some aspects of the present invention, the scope of which is defined in the claims.

The present invention has proven to be particularly advantageous when applied to containers suited to contain fluid products. More preferably, the present invention has proven to be particularly advantageous when applied to deformable containers suited to contain bath or cosmetic products, for example bath products like shampoos, bath foams, toothpastes, or cosmetic products like cosmetic creams or the like, that therefore come in the liquid form, with higher or lower density, or in the form of a paste. It should however be noted that the present invention is not limited to such usage. On the contrary, the present invention can be usefully applied in all cases requiring the use of a deformable container suited to contain a fluid product that is easy to dispense, for example deodorizers, hair removal creams, or containers for pharmaceutical or veterinary products, or containers for cooking products like mayonnaise, sauces, or even containers for bonding substances and the like.

With reference to Figures from 1 to 7, here below is the description of a first embodiment of a container 1 according to the present invention; in the figures similar or equivalent characteristics and/or component parts are identified by the same reference numbers.

Figure 1:
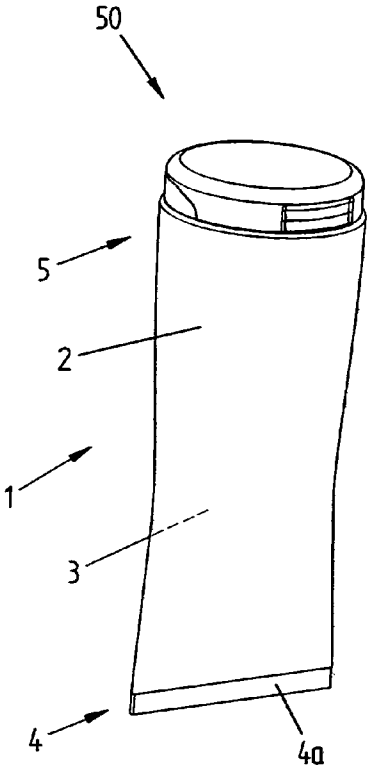
FIG. 1 shows an axonometric view of a container provided with a cap according to a first embodiment of the invention.
Figure 4:
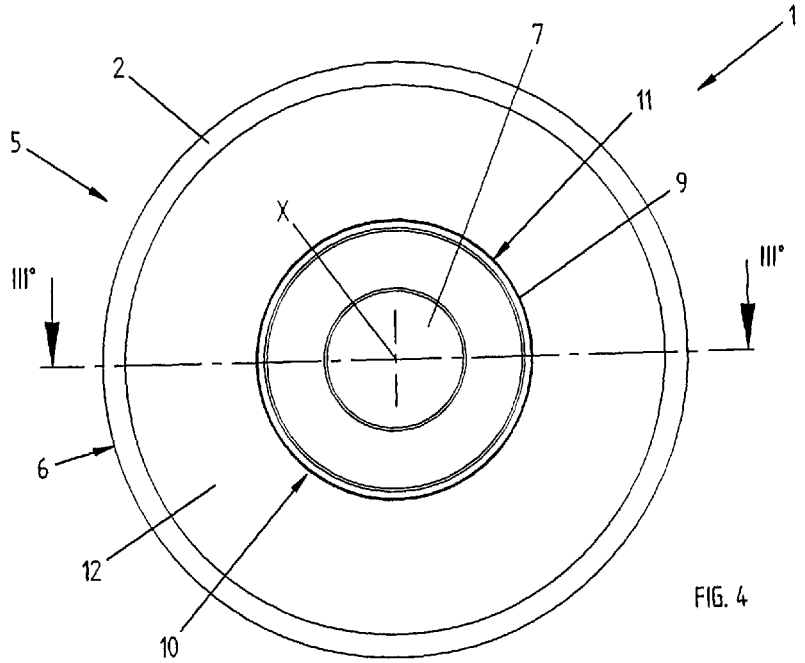
FIG. 4 shows a plan view of the container shown in FIG. 1.

In FIG. 1 the container 1 according to the invention is shown provided with a closing element or cap 50 in the closed configuration.

The container 1 shown in the figure is a container of the tubular type suited to contain fluids consisting, for example, of toothpaste, bath foam, a cosmetic cream, etc.

The container 1 is preferably made of an elastically yielding material, preferably a plastic material, suited to be squeezed in order to force the fluid out, as shown in the configuration of FIG. 3. The plastic materials suited to be used for this purpose are polypropylene (PP), polyethylene (PELLD, PELD, PEMD, PEHD) and other materials known as ABL, PBL, PCR, soft touch resin.

However, in variant embodiments of the invention the container may be suited to contain different types of fluid, and also the material used to make it may be different. For example, as explained above, according to the invention it may be possible to use a deformable container suited to contain products like deodorizers, hair removal creams, or containers for pharmaceutical or veterinary products, or containers for cooking products like mayonnaise, sauces, or even containers for bonding substances and the like.

According to further variant embodiments of the invention, furthermore, only a portion of the container may be elastically yielding and deformable to allow the product to flow out.

Preferably, said elastically yielding portion will be far from the closing element 50, so that during the deformation stage it affects only slightly the fluid outlet area, where the closing element is applied.

The closing element 50, hereinafter simply referred to as "cap", is applied to the container 1 through a snap-in connection, as will be described in greater detail below.

According to variant embodiments of the invention, however, the cap may be associated with the container in a different way, for example via a screwing operation or through equivalent connection means.

The container 1 comprises a main body 2 that defines an inner area 3 suited to house the product to be dispensed, said product not being indicated in the figures. The main body 2, preferably in a tubular cylindrical shape, substantially extends from a first closed terminal area 4, or lower end of the container 1, to a second terminal area 5, or upper end of the container 1, from which the product can be dispensed.

The lower end 4 of the main body 2 has a preferably squeezed configuration and is closed along a portion of the edge 4*a*. In case of use of plastic materials, said edge 4*a* is advantageously obtained by closing it via a heat-sealing process once the product has been put in the inner area 3 of the main body.

The main body 2 develops towards the upper end 5 terminating with a distal edge 6, preferably circular in shape.

In the upper end 5 of the container 1 there is also an opening 7 for dispensing the product, suited to place the inner area 3 containing the product in communication with the outside.

The upper end 5 of the container 1 is also associated with connection means 8 suited to allow it to be coupled with corresponding connection means 54 of the cap 50.

Figure 5:
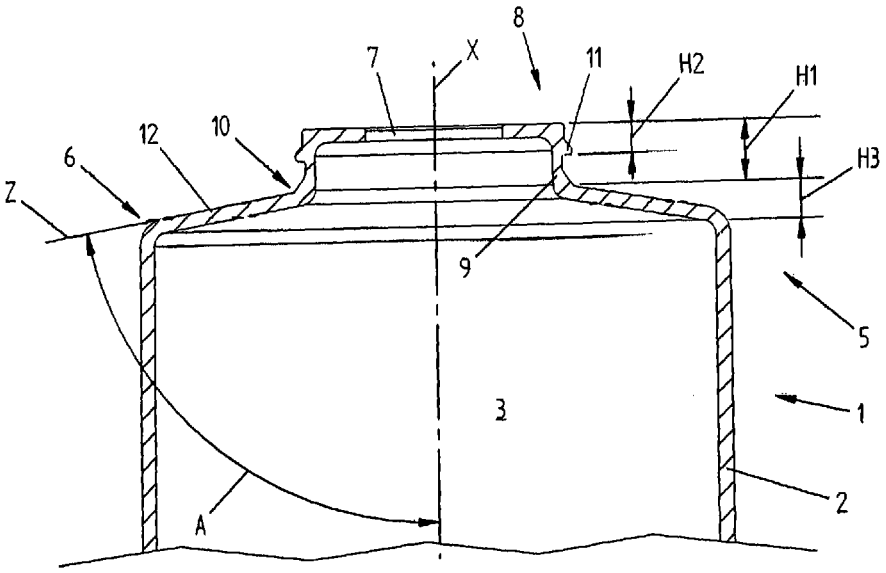
FIG. 5 shows a partial sectional view of FIG. 4 along line III°-III°.

The connection means 8 comprise a projecting portion 9 that extends from a base area 10 along a main axis X. The projecting portion 9 extends over a prefixed distance H1, or height, as shown in FIG. 5.

The projecting portion 9 preferably comprises a substantially cylindrical tang.

The main axis X substantially corresponds to the axis of the cylindrical tang 9.

The outer surface of the tang 9 is provided with a peripheral coupling tooth 11 suited to allow a snap-in connection with the cap 50, as will be better described below.

The peripheral coupling tooth 11 is situated at a prefixed distance in the direction defined by the main axis X from the distal end of the tang 9, a distance indicated by H2 in FIG. 5.

According to variant embodiments of the invention, as already explained, different and equivalent connection means can be provided. For example, a screw-in connection can be provided, in which case on the outer surface of the cylindrical tang there will be a thread suited to be engaged in a corresponding portion of nut screw created in the cap.

The dispensing opening 7 is preferably made in the distal end of the tang 9.

The size and shape of the dispensing opening 7 can be different from time to time, according to the size of the tube and/or to the type of product to be dispensed.

Between the distal edge 6 of the main body 2 and the base area 10 from which said tang 9 develops there is a transition area 12. In the preferred embodiment of the invention illustrated herein the transition area 12 comprises a substantially truncated cone-shaped surface with long base defined by the distal edge 6 and short base defined by the base area 10 of the tang 9.

Figure 18:
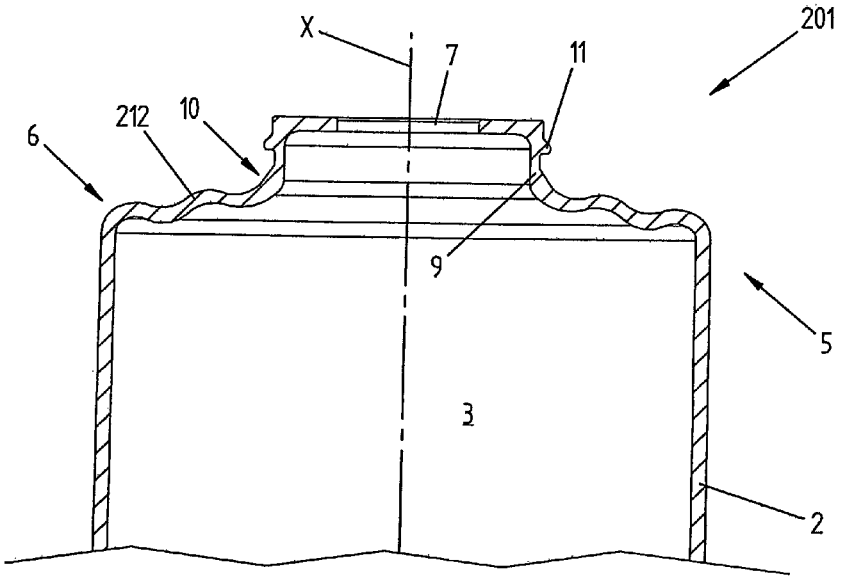
FIG. 18 shows a sectional view of a detail of a variant embodiment of the container of the invention.

According to variant embodiments of the invention, said transition surface can have a different shape, as shown for example in the container 201 of FIG. 18, in which the transition surface 212 is waved.

According to other variant embodiments of the invention, the transition surface can also have variable thickness along its extension between the distal edge of the main body and the base area of the tang.

The transition area 12 extends longitudinally along the main axis X over a given section, or height, indicated by H2 in FIG. 5.

The distal edge 6 and the base area 10 are crossed by an inclined axis Z defining an angle A with respect to the main axis X defined by the connection means 8.

The upper end of the container, in particular the connection means 8 and the transition area 12, is preferably made of a material featuring higher mechanical hardness than the main body 2. Thanks to the above, the connection to the cap 50 features suitable mechanical resistance.

Typically, the main body 2 and the upper end 5 are produced separately using the two different materials and then connected to each other by heat sealing.

Figure 6:
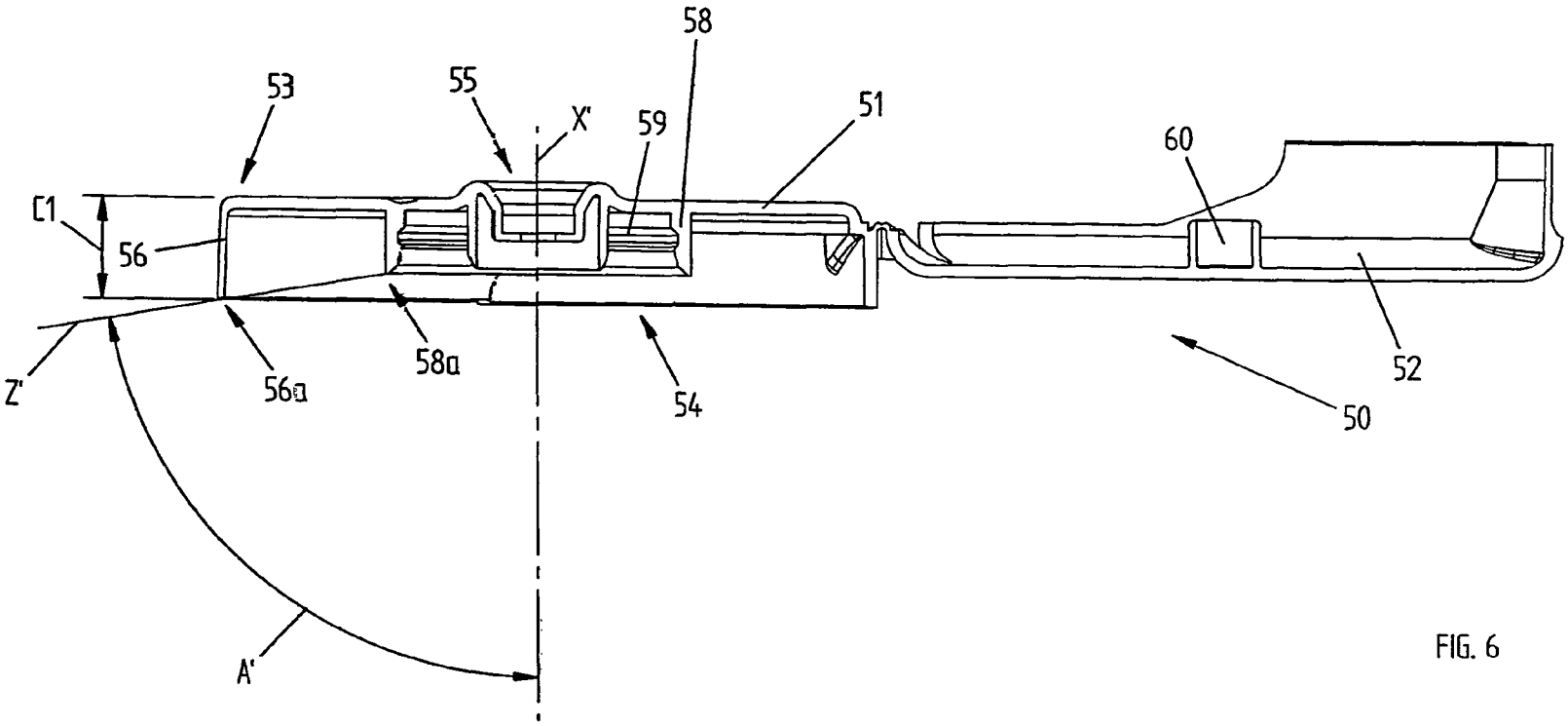
FIG. 6 shows a sectional view of the cap in open configuration as shown in FIG. 2.

Regarding the cap 50, better visible in FIG. 6, it comprises a base portion 51 suited to be connected to the container 1 and provided with a dispensing hole 55 associated with a moving element 52, or cover, suited to intercept the dispensing hole 55.

For this purpose, the cover 52 is provided with a reference element 60 suited to be fitted in the dispensing hole 55 of the base portion 51.

The cover 52 can be moved, in the case at hand rotated, so that it comes to be in a configuration in which the dispensing hole 55 is closed, that is, the cap 50 is closed, as shown for example in FIG. 1, or in a configuration in which the dispensing hole 55 is open, that is, the cap 50 is open, as shown for example in FIGS. 2, 3, 6 and 7.

The base portion 51 comprises a collar 53 and connection means 54 for connection to the corresponding connection means 8 of the container 1.

Figure 7:
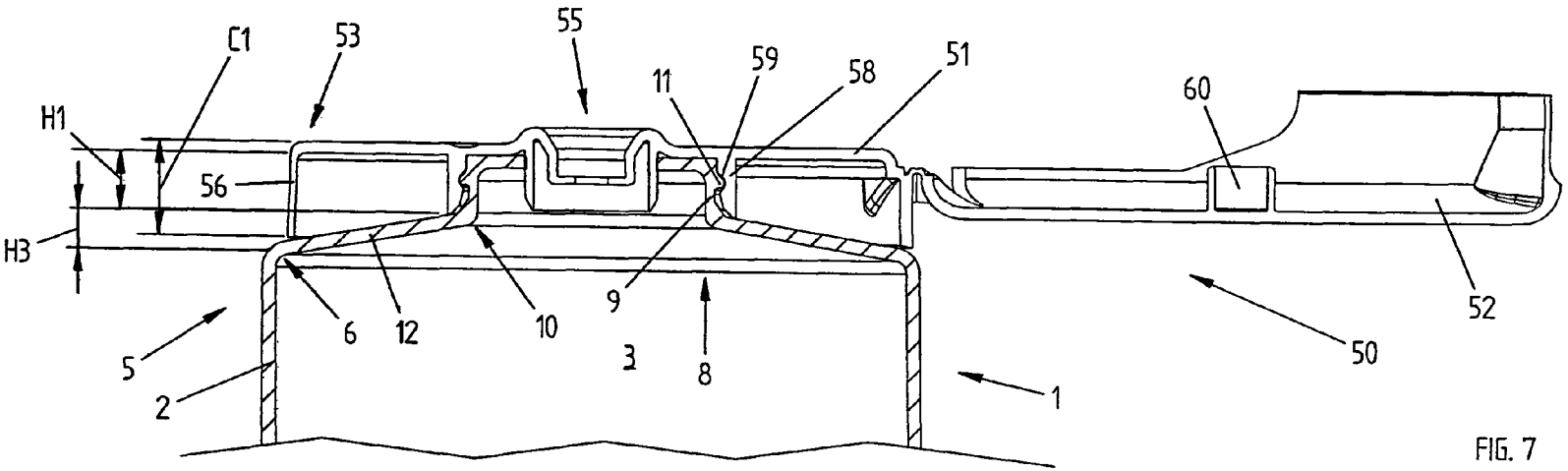
FIG. 7 shows a partial sectional view of FIG. 2, meaning the cross section of the open cap applied to the upper portion of the container.

The collar 53 comprises a lateral surface 56 with prefixed height C1 whose shape substantially matches the shape of the distal edge 6 of the main body 2 of the container, as shown in FIG. 7.

The lateral surface 56 comprises an edge 56*a* suited to be arranged so that it bears against the upper end 5 of the container 1.

In the first embodiment of the invention illustrated herein, the collar 53 has therefore a substantially cylindrical shape with a corresponding circular edge 56*a*.

The collar 53 of the cap 50 adheres in an optimal way to the distal edge 6 of the main body 2 thus advantageously providing an extension of the main body 2 of the container 1.

Thanks to the above, the unit made up of the container 1 and the cap 50 has a compact structure that is comfortable to handle and offers suitable tightness.

The connection means 54 comprise a connection portion 58 that extends along a main axis X'. The connection portion 58 preferably comprises a cylindrical portion whose inside is provided with a recessed annular seat 59 suited to accommodate the peripheral coupling tooth 11 of the tang 9 of the container 1 that is snapped therein, as shown in FIG. 7.

The cylindrical portion 58 ends in a terminal area 58*a* suited to be placed in contact with the connection means 8 of the container 1.

The edge 56*a* of the lateral surface 56 of the collar 53 and the terminal area 58*a* of the connection means 54 are crossed by an inclined axis Z' defining an angle A' with respect to the main axis X' defined by the connection means 54.

Analogously to what has been stated above with reference to the connection means of the container, also the connection means of the cap may be different. For example, the peripheral tooth can be provided on the cap instead of on the tang, with a corresponding recessed seat obtained in the tang. Again, the inside of the cylindrical portion can be provided with a portion of nut screw so that it can be coupled with a portion of thread provided on the tang of the container.

The parts making up the cap 50 are advantageously made in a single body by moulding a plastic material, for example polypropylene or polyethylene.

According to the present invention, the container 1 advantageously has an angle A whose amplitude is almost 90°.

The angle A is preferably included between 70° and 90°.

More preferably, the angle is included between 75° C. and 85° C., even more preferably it is equal to 80° C.

Establishing such a value for the angle A makes it possible to obtain a transition area 12 with reduced height H3 compared to the solutions of the known art.

The reduction of the height H3 of the transition area 12 makes it possible to use a cap 50 in which the height C1 of the lateral surface 56 of the collar 53 is in turn reduced. As shown in FIG. 7, in fact, the value of the height C1 of the lateral surface 56 of the collar 53 is proportionally related to the height H3 of the transition area 12.

The container 1 according to the invention thus makes it possible to use a cap 50 with reduced dimensions compared to known art, in particular regarding the extension of the collar 53, with a consequent reduction of the material used and of the related production costs.

Furthermore, establishing such a value for the angle A, exceeding the values of approx. 60° that are typical of the known art, makes it possible to increase the volume of the inner area 3 that houses the product, or, with the same quantity of product, makes it possible to reduce the length of the container 1. The overall dimensions of the container 1 and thus the overall dimensions of the unit made up of the container 1 and the cap 50 are consequently reduced.

Finally, establishing such a value for the angle A makes it possible to reduce to a minimum the risk of the cap 50 coming off the container 1, in particular when the container 1 is squeezed to dispense the product.

Always according to the present invention, the ratio between the extension H3 of the transition area 12 along the main axis X and the extension H1 of the connection means 8 of the container 1 along said main axis X is preferably included between 0 and 2.5.

Said ratio is more preferably included between 0 and 2, even more preferably it is equal to 1.5.

Established in such a dimensional value makes it possible to improve the sizing of the cap 50 to be applied to the container 1 regarding the corresponding ratio between the extension of the means for connection to the container 1 and the height C1 of the lateral surface 56 of the collar 53.

The extension H1 of the connection means 8 of the container 1 is preferably included between 1 mm and 6 mm.

More preferably, said extension H1 is included between 1.5 mm and 5 mm, even more preferably it is equal to 4 mm.

The distance H2 of the coupling tooth 11 is preferably included between 1 mm and 3 mm.

More preferably, said extension H2 is included between 1.5 mm and 2.5 mm, even more preferably it is equal to 2 mm.

The extension H3 of the transition area 12 is preferably included between 0 mm and 10 mm.

More preferably, the extension H3 of the transition area 12 is included between 0 mm and 6 mm, even more preferably it is equal to 3 mm.

Always according to the present invention, the cap 50 advantageously has an angle A' whose amplitude is substantially the same as that of the angle A of the container 1 described above.

The angle A' is preferably included between 70° and 90°.

More preferably, the angle A' is included between 75° C. and 85° C., even more preferably it is equal to 80° C.

The height C1 of the lateral surface 56 of the collar 53 is preferably included between 1 mm and 16 mm.

More preferably, said height C1 is included between 3 mm and 11 mm, even more preferably it is equal to 7 mm.

Figure 8:
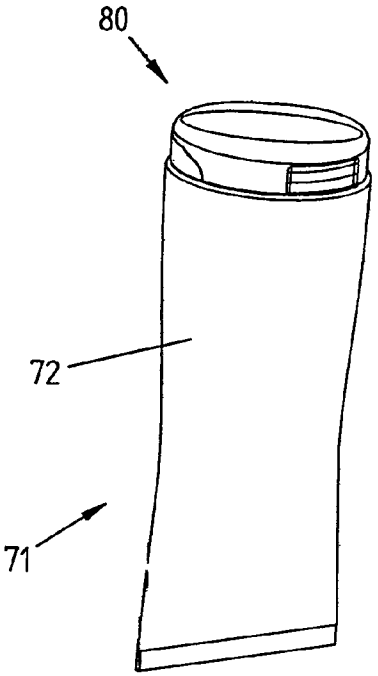
FIG. 8 shows an axonometric view of a container provided with a cap according to a first different embodiment of the invention.

FIG. 8 shows a construction variant of the container 71 of the invention.

Said variant differs from the embodiment described above with reference to Figures from 1 to 7 due to the different shape of the main body 72 whose tubular form is elliptical instead of cylindrical.

Figure 9:
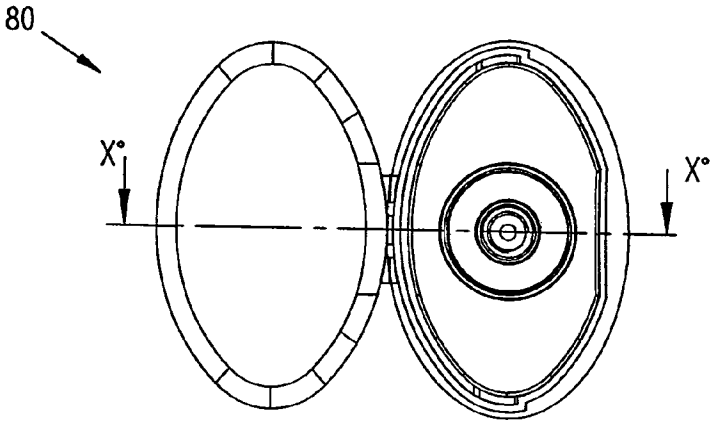
FIG. 9 shows a plan view of the cap shown in FIG. 8.
Figure 10:
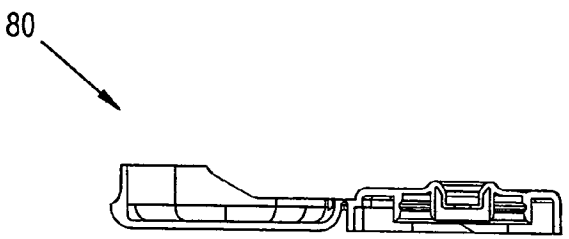
FIG. 10 shows a sectional view of FIG. 9 along line X°-X°.

The corresponding cap 80, shown in FIGS. 9 and 10, will have a matching elliptical profile.

Figure 12:
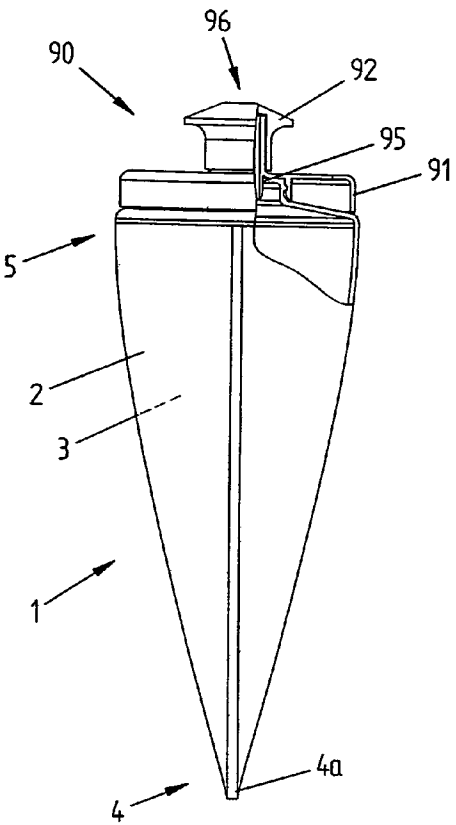
FIG. 12 shows a side view of FIG. 11 in partial cross section.
Figure 11:
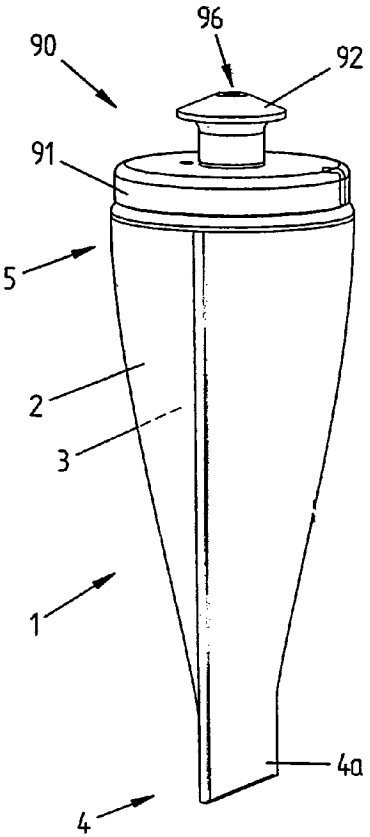
FIG. 11 shows an axonometric view of a container provided with a cap according to a different embodiment of the invention.

Another variant embodiment of the invention is described with reference to FIGS. 11 and 12.

Said variant differs from the embodiment described with reference to Figures from 1 to 7 due to the different shape of the cap 90.

In particular, the cap 90 comprises a base portion 91 suited to be connected to the container 1 and provided with a dispensing hole 95 associated with a moving element 92 suited to intercept the dispensing hole 95.

The moving element 92 is also provided with a dispensing hole 96.

The moving element 92 can be moved via a translation motion so that it comes to be in a configuration in which the dispensing hole 95 is closed, that is, the cap 90 is closed, or in a configuration in which the dispensing hole 95 is open, that is, the cap 90 is open, and the product can flow out of the dispensing hole 96 of the moving element 92.

Figure 13:
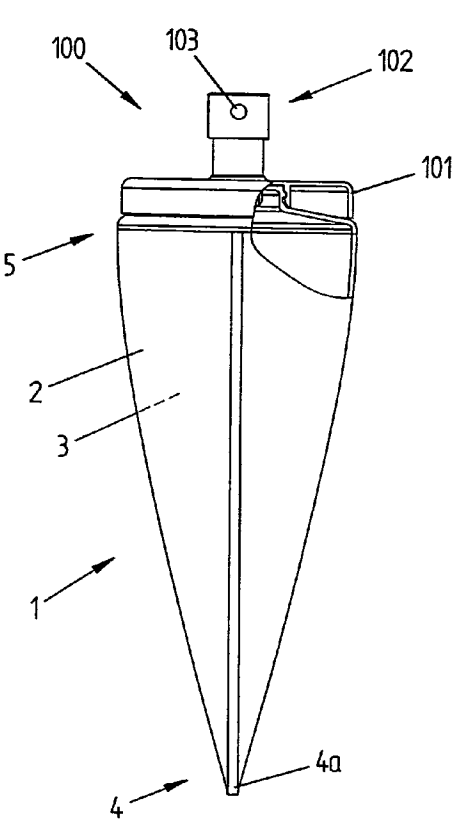
FIG. 13 shows a variant embodiment of FIG. 12.

Another variant embodiment of the invention is described with reference to FIG. 13.

Said variant differs from the embodiment described with reference to Figures from 1 to 7 due to the different shape of the cap 100.

In particular, the cap 100 is provided with a spraying system, in particular for dispensing liquid products like perfumes.

The cap 100 thus comprises a base portion 101 suited to be connected to the container 1 and provided with a dispensing device 102 that allows the liquid product to be sprayed out through a suitable nozzle 103.

Another variant embodiment of the invention is described with reference to FIGS. 14 and 15.

Said variant differs from the embodiment described with reference to Figures from 1 to 7 due to the different shape of the cap 110.

In particular, the cap 110 comprises a base portion 111 suited to be connected to the container 1 and provided with a dispensing hole 115 associated with a moving element 112 in the shape of a spout that is suited to intercept the dispensing hole 115. The spout 112 is provided with an outlet channel 113.

Figure 15:
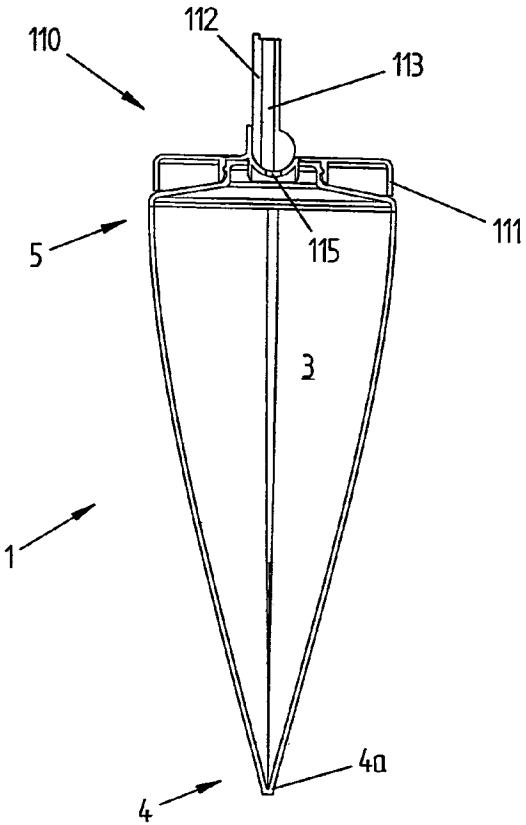
FIG. 15 shows the container provided with cap of FIG. 14 in a second operating condition.
Figure 14:
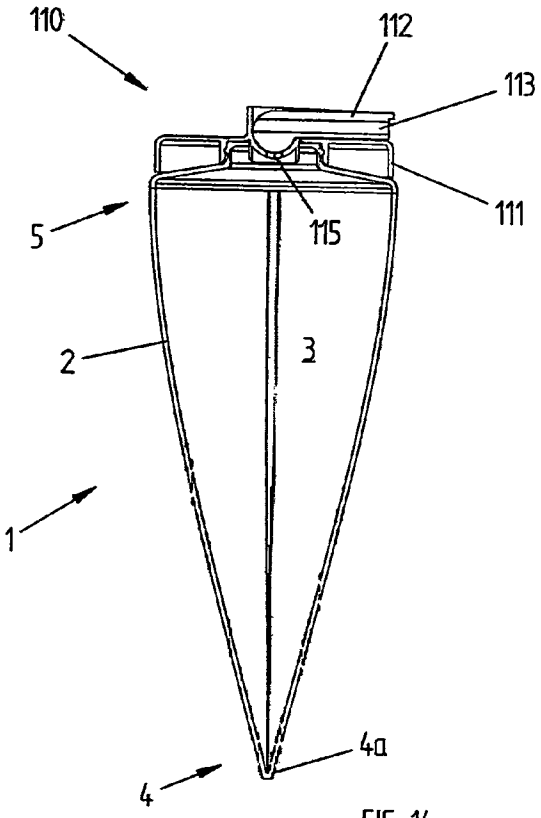
FIG. 14 shows another variant embodiment of FIG. 12 in a first operating condition.

The spout 112 can be rotated so that it comes to be in a configuration in which the dispensing hole 115 is closed, that is, the cap 110 is closed, as shown in FIG. 14, or in a configuration in which the dispensing hole 115 is open and communicates with the outlet channel 113, that is, the cap 110 is open, as shown in FIG. 15.

In further construction variants, the cap can be of any type known in the sector.

For example, the cap can be of the pump type, in which the fluid outflow is favoured by operating a moving pumping element associated with the cap itself, or even a cap suited to dispense foam, or again a cap suited to dispense a nebulized product.

Figure 16:
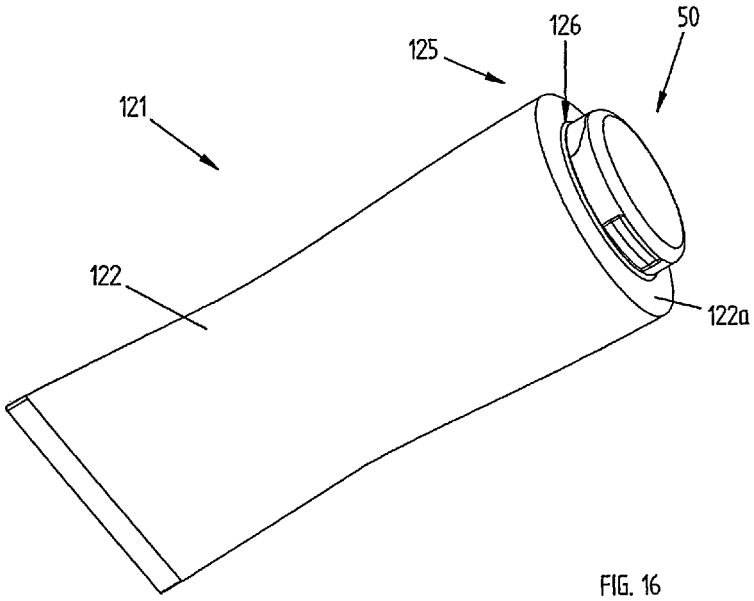
FIG. 16 shows an axonometric view of a container provided with a cap according to a different embodiment of the invention.
Figure 17:
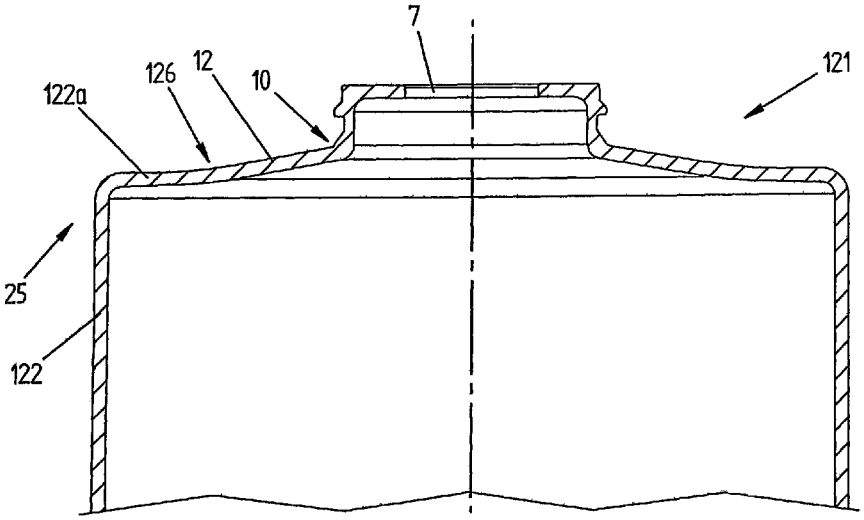
FIG. 17 shows a side view of the container shown in FIG. 16 in partial cross section.

Another variant embodiment of the invention is described with reference to FIGS. 16 and 17.

Said variant differs from the embodiment described with reference to Figures from 1 to 7 due to the different shape of the container 121.

In particular, the main body 122 of the container 121 has at its upper end 125 a shoulder 122*a* that ends in the circular edge 126 where the transition area 12 begins. Said transition area 12, visible in FIG. 17, will have the same characteristics described above with reference to the first embodiment.

The description provided above thus shows that the container that is the subject of the invention allows the set objects to be achieved, in particular it allows the application of a closing element with reduced size and cost compared to the known art.

While the present invention has been described with reference to the particular embodiments shown in the figures, it should be noted that the present invention is not limited to the specific embodiments illustrated and described herein; on the contrary, further variants of the embodiments described herein fall within the scope of the present invention, scope which is defined in the claims.

The invention claimed is:

1. Tube like deformable container for a fluid product, comprising:

a main body suited to define an inner area where the fluid product is contained, said main body ending with an edge in a terminal area of said container, said main body substantially extending from a first closed terminal area to said terminal area from which the product can be dispensed, said first closed terminal area having a squeezed configuration and being closed along a portion of an edge;

an opening for dispensing the fluid product associated with said terminal area of said container;

snap in connection means suited to allow the connection of a closing element for said opening, said snap in connection means comprising a projecting portion that extends longitudinally along a main axis from a base area associated with said terminal area of said container;

a transition area suited to connect said edge of said main body to said base area of said snap in connection means;

wherein at least one portion of said edge of said main body and at least one portion of said base area of said snap in connection means are crossed by an inclined axis that together with said main axis of said projecting portion defines an angle included between 75° and 85°; and in that the ratio between a first extension of said transition area along said main axis and a second extension of said snap in connection means along said main axis is greater than 0.3 and less than 2.5.

2. The container according to claim 1, wherein said angle is equal to 80°.

3. The container according to claim 1 wherein said ratio is less than 2, and more preferably is equal to 1.5.

4. The container according to claim 1, wherein said transition area has the shape of a truncated cone.

5. The container according to claim 1, wherein said main body is tubular in shape.

6. The container according to claim 1, wherein said main body comprises at least one elastically yielding portion.

7. The container, according to claim 1 wherein said projecting portion (9) comprises a cylindrical portion.

8. The container according to claim 1, wherein said main axis coincides with an axis of said cylindrical portion.

9. The container according to claim 8, wherein said lower end of the main body is closed along a portion of the edge by closing it via a heat-sealing process once the product has been put in the inner area of the main body.

10. A unit comprising a fluid container and a closing element associated with said container, wherein said fluid container is a container according to claim 1.

11. The unit according to claim 10, wherein said closing element comprises:

a base portion comprising a collar having an edge suited to be arranged so that it bears against a terminal area of said container;

connection means suited to allow connection to said container, said connection means comprising a connecting portion that extends longitudinally along a main axis and ends in a terminal area suited to be placed in contact with said snap in connection means of said container;

an opening for the passage of said product coming from said container and means for opening/closing said opening, wherein at least one portion of said edge of said base portion and at least one portion of said terminal area of said connection means are crossed by an inclined axis that together with said main axis of said connecting portion defines an angle included between 75° and 85°.

12. The unit according to claim 11, wherein said angle is equal to 80°.

13. The container according to claim 1 wherein:

said ratio is equal to 1.5.

14. A deformable container for dispensing a fluid product comprising:

a main body having a longitudinal main axis;

an opening formed in said main body, said opening having the longitudinal main axis extending there through;

a cap having a collar with a lateral surface with an edge and a terminal area forming a first inclined axis extending between the edge of said lateral surface and the terminal area having a first angle between a portion of the longitudinal main axis extending within said main body and the first inclined axis;

a projecting portion formed in said main body having an adjacent base area and an opening, said projecting portion extending a projecting portion height ranging from between 1mm and 6mm from the base area to the opening along the longitudinal main axis;

a coupling tooth formed on said projecting portion at a coupling tooth height from the opening;

a recessed annular seat formed in said cap adjacent said terminal area mating with said coupling tooth formed on said projecting portion;

a transition area extending from the adjacent base area of said projecting portion to a distal edge of said main body forming a second inclined axis having a second angle between the portion of the longitudinal main axis extending within said main body and the second inclined axis and having a height of transition along the longitudinal main axis of said main body ranging from between 0mm and 6mm;

wherein said first and second inclined axes form an angle between the portion of the longitudinal main axis extending within said main body of between seventy and ninety degrees; and wherein the ratio between the height of transition and the projecting portion height is between 0.3 and 2.5.

15. A deformable container for dispensing a fluid as in claim 14 wherein:

said first and second inclined axes form an angle between the portion of the longitudinal axis extending within said main body of between seventy-five and eighty-five degrees.

16. A deformable container for dispensing a fluid as in claim 15 wherein:

said first and second inclined axes form an angle between the portion of the longitudinal axis extending within said main body equal to substantially eighty degrees.

* * * * *